United States Patent [19]

Yarden et al.

[11] 4,016,835

[45] Apr. 12, 1977

[54] MOISTURE SEPARATOR-REHEATER

[75] Inventors: Abraham L. Yarden; Robert A. Weisberg, both of Los Angeles, Calif.

[73] Assignee: Southwestern Engineering Company, Los Angeles, Calif.

[22] Filed: Aug. 1, 1975

[21] Appl. No.: 601,079

[52] U.S. Cl. ..... 122/483; 165/146; 165/159; 165/163

[51] Int. Cl.[2] ..... F22G 1/00; F28F 13/00

[58] Field of Search ..... 122/32, 33, 483; 165/146, 157–163

[56] References Cited

UNITED STATES PATENTS

| | | | |
|---|---|---|---|
| 1,524,520 | 1/1925 | Junkers | 165/146 |
| 1,627,265 | 3/1927 | Bancel | 165/146 |
| 3,712,272 | 1/1973 | Carnavos | 122/483 |

*Primary Examiner*—Kenneth W. Sprague
*Attorney, Agent, or Firm*—Lyon & Lyon

[57] ABSTRACT

A device for separating moisture from steam and reheating the steam for use in power generating facilities. The moisture separator-reheater is horizontally disposed with inertial separators and heat exchange tubes extending longitudinally through the shell such that flow is received at the bottom of the moisture separator-reheater, passed through the inertial separators, and then directed upwardly through one or more tube bundles to exhaust at the top of the unit. The inertial separators are disposed in two banks diverging upwardly from a common drain to locations on either side of the tube bundle. The incoming flow of wet steam is divided and directed toward each separator bank. The flow is then deflected laterally to evenly distribute steam along the entire length of each separator bank. Perforated plates, positioned in front of the separator banks, also act to further distribute the incoming moist flow. The moisture separator-reheater is also designed to minimize thermal stress during nonsteady state heating and cooling. Horizontal tubes are employed as part of the reheater tube bundles. Different diameter tubes are used in each tube bundle to prevent excessive cooling in a portion of the tubes which would lead to improper circulation of the tube-side steam. The heat exchange surfaces of the tubes are also varied to obtain a more desirable tube-side flow. Plates and flapper relief gates also reduce nonsteady state thermal stress. A drain system is also employed which minimizes problems of flashing.

19 Claims, 10 Drawing Figures

FIG. 7
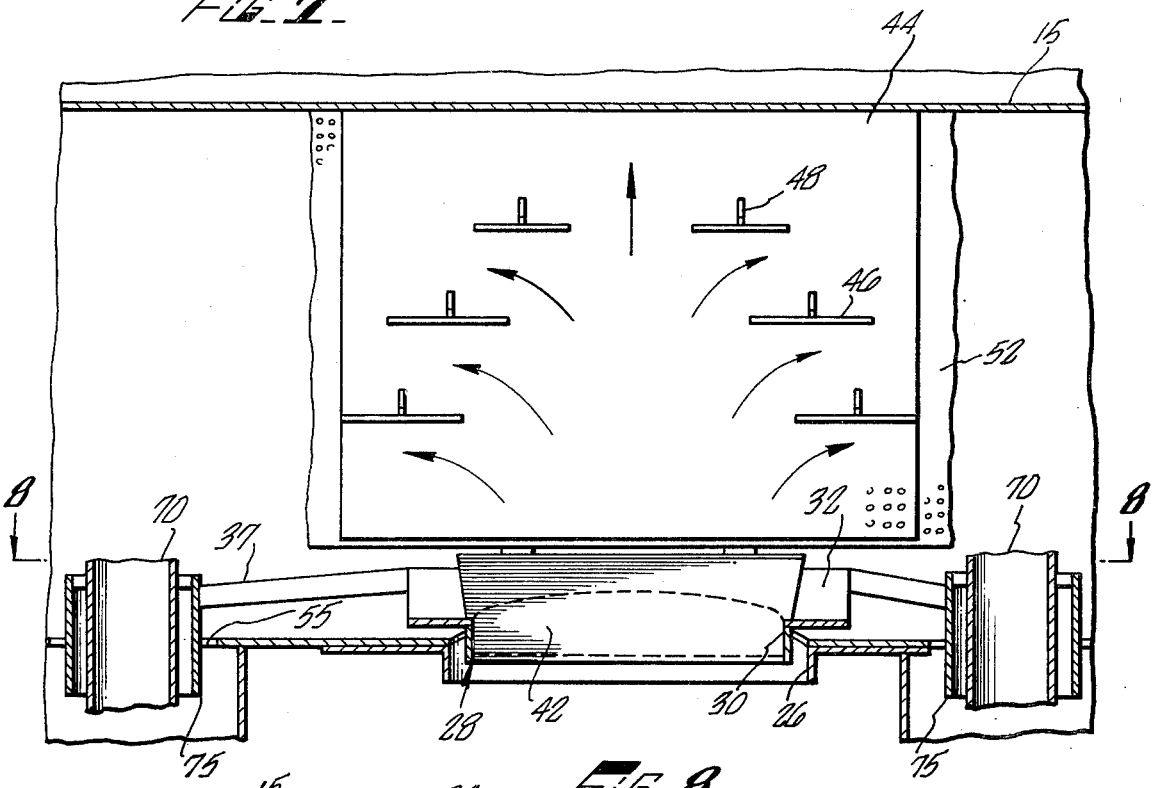
FIG. 8
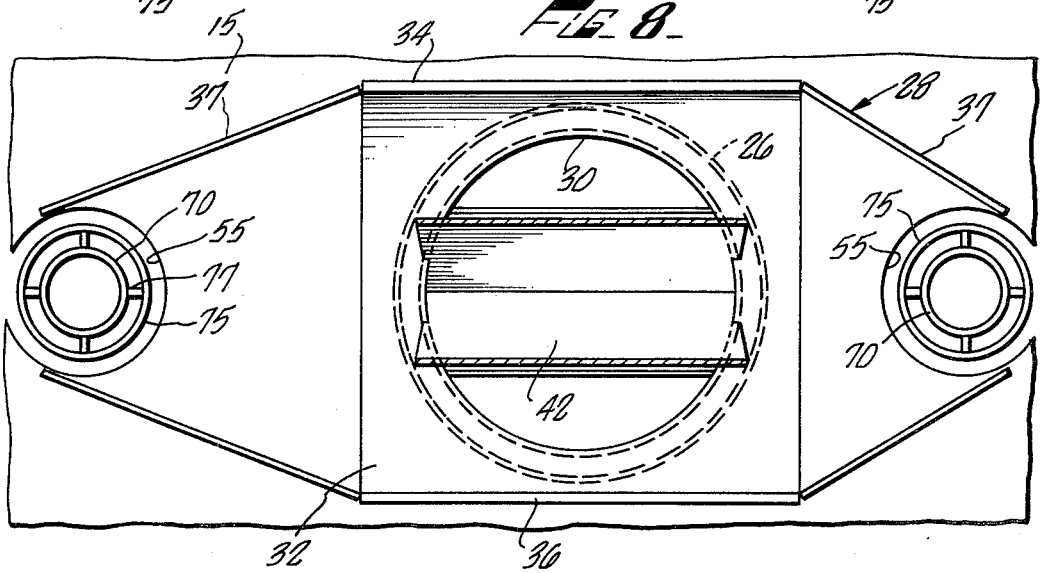
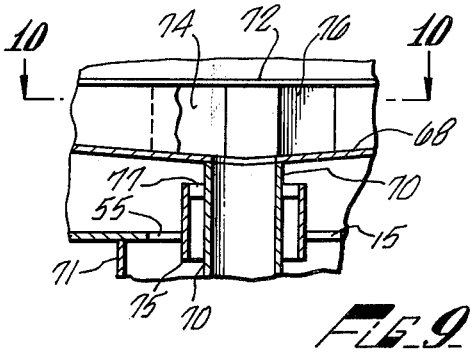
FIG. 9
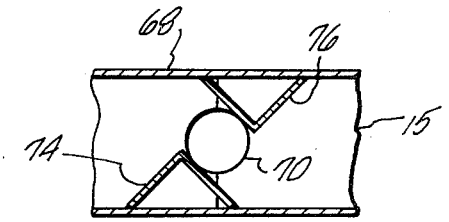
FIG. 10

MOISTURE SEPARATOR-REHEATER

BACKGROUND OF THE INVENTION

The present invention is directed to moisture separator-reheaters for steam power generation.

Moisture separator-reheaters for steam power generation typically employ large cylindrical shells containing moisture separators and heat transfer tubes extending therethrough. The separators are of the inertial type and separate water from wet steam exhausted from the high pressure turbine. The steam is then directed to the heat exchange portion of the unit. The heat transfer tubes of the heat exchange unit are arranged in one or more bundles and employ throttle steam to reheat the main steam flow. The throttle steam is ideally controlled such that all of the tube-side steam is condensed but not subcooled. The separated shell-side water is then exhausted from the bottom of the unit while dry steam is passed to the low pressure turbine. Such drying and reheating of the low pressure steam improves overall system efficiency and reduces moisture to the low pressure turbine. Only a limited number of inlets can advantageously be used for introducing the moist steam into such units. Because of the size of these units, the volume of flow of the influent and the pressure drop between the inlets and outlets, it is difficult to obtain uniform flow through both the inertial separators and the heat exchange tube bundles. European practice has been to vertically dispose such moisture separator-reheaters and introduce steam at one end. Horizontally disposed moisture separator-reheaters in the United States have also been designed with an inlet at one end.

Because of the length and horizontal disposition of American type moisture separator-reheaters, it is believed that a significant portion of the flow passes directly from the inlet to the inertial separators and onto the tube bundles without first becoming distributed along the total length of the vessel. This improper distribution results in both inefficient separation of moisture and inefficient heating of the dried steam.

The substantial length of such separators, the variations in temperature throughout the unit at steady state conditions and the rapid heating and cooling which may occur during nonsteady state conditions have created major problems in the design and operation of horizontally disposed moisture separator-reheaters. Reheater tube bundles with vertically disposed U-bends can experience damaging thermal stress during nonsteady state conditions because of large variations in temperature caused by the entry of hot or cold flow into either the inlets or outlets of the vessel.

A common problem with horizontally disposed moisture separator-reheaters is the unequal heat transfer occurring in the tubes of each tube bundle. The lowermost tubes are subjected to a high temperature differential while tubes higher in the tube bundle receive shellside flow which has already been partially heated by the lower tubes. As a result, the lower tubes tend to accumulate water until they no longer carry steam along their entire length. Subcooling of the water in the lower tubes may then occur while steam passes through the entire length of tubes higher up in the bundle. Such occurrences create an unstable two-phase condition resulting in cyclical filling and emptying of the lower tubes with water. This condition leads to less efficient overall heat transfer and cyclical thermal stresses on the tubes and tube sheet.

Another problem experienced by moisture separator-reheaters is the flashing of shell-side water to steam as it is passing from the system. Such flashing can damage components, throw water into the reheater bundles and eventually through the steam outlets, create surges of steam to the low pressure turbine and generally detract from the efficient operation of the moisture separator-reheater.

SUMMARY OF THE INVENTION

The present invention is directed to improved flow distribution and heat transfer control in moisture separator-reheaters. An arrangement of the heat transfer unit or units with the inertial separators has been employed in the present invention to create longitudinally extending passageways along the lower sides of the vessel. Moist, low pressure steam is introduced at the underside of the vessel to flow through these longitudinally extending passageways for introduction to the inertial separators. The passageways along with the properly placed inlet passageways make possible a proper distribution of flow for better use of the inertial separators and the reheater tube bundles.

To further distribute the incoming flow, each inlet is provided with a means for dividing the flow between each of the longitudinal passageways. Flow distribution means are positioned near the inlets to intercept and redirect the divided flow down the longitudinally extending passageways. The flow distribution means in this way employ the velocity of the incoming flow to enhance the efficiency of both the inertial separators and the reheater tube bundles through the uniform distribution of flow thereto. Perforated plates having perforations perpendicular to the redirected flow also enhance this redistribution of flow to the inertial separators and onto the reheater tube bundles. Thus, the present invention provides more efficient use of both the inertial separators and the reheater tube bundles through proper distribution of flow into the moisture separator-reheater.

Tubes having horizontally disposed U-bends are employed in the present invention. The horizontal disposition of these tubes reduces the problem of extreme thermal stress encountered during non-steady state conditions with tube bundles having the conventional vertically disposed U-bend tube configuration. When vertically disposed, the upper leg of each pair of tube legs experiences the hotter or colder flow during the non-steady state conditions after the lower leg of each pair thereby creating extreme stress in the tubes. By horizontally disposing the tubes, each leg of each pair of legs experiences similar flow at similar times.

Heat transfer control is also provided in moisture separator-reheaters of the present invention. The common problem of unequal heat transfer between the lowermost tubes and the upper tubes resulting in subcooling of the flow in the lower tubes has been overcome in the present invention by employing larger tubes at the bottom of each tube bundle. This arrangement is made possible by the use of horizontally disposed U-bend tubes. The larger tubes allow a greater flow of steam, increased drainage of water and a lower rate of heat transfer per unit of steam than would occur in a tube of smaller diameter. Where the shell-side flow has been heated substantially, smaller tubes are employed to enhance the rate of heat transfer per unit of steam and to allow somewhat less flow than is experienced by the larger, lower tubes. Greater packing is also possible in the upper portion of the tube bundle to further increase tube bundle efficiency. Thus, maximum use of the latent heat of condensation for all of the tube-side flow may be approached.

The surface characteristics of the tubes may also be varied to obtain the proper heat transfer from each tube. Both integrally finned and plain tubing are used to create the proper heat transfer in each tube. Thus, heat transfer control is maintained in horizontally disposed U-bend tube bundles for maximum reheater efficiency through variations in tube diameter and in tube surface characteristics.

To further enhance the structural performance of the moisture separator-reheaters of the present invention during non-steady state conditions, protective plates are positioned at the ends of the vessel to inhibit flow past the tube sheets. To prevent buckling of these plates, a simple flapper valve is used to allow the equalization of large pressure differences across each plate.

The proper drainage of the moisture separator-reheater has also been accomplished by the present invention. Heretofore, the separated water experienced a propensity to flash before being drained from the moisture separator-reheater shell. By the present invention, the water inventory in the shell is kept to a minimum. The drainage system of the present invention further inhibits the bypass of steam through the drainage system which may both inhibit flow of water from the shell and reduce the amount of steam reheat available for passage to the low pressure turbine.

Accordingly, it is an object of the present invention to provide an efficient moisture separator-reheater.

It is another object of the present invention to provide a moisture separator-reheater having improved flow distribution to moisture separator and reheater units.

It is a further object of the present invention to provide a moisture separator-reheater having heat transfer control for optimum heat transfer efficiency.

Another object of the present invention is to provide a moisture separator-reheater designed to minimize thermal stress during nonsteady state conditions.

Moreover, it is an object of the present invention to reduce the possibility of damage resulting from flashing.

It is a further object of the present invention to provide a drainage system which will prevent the bypass of dried steam therethrough.

Other and further objects and advantages will appear hereinafter.

BRIEF DESCRIPTION OF THE DRAWINGS

FIG. 7 is a cross-sectional view taken along line 7—7 of FIG. 4.

FIG. 8 is a detailed cross-sectional plan taken along line 8—8 of FIG. 7.

FIG. 9 is a detailed evelation in cross section of a drain.

FIG. 10 is a detailed cross-sectional plan taken along line 10—10 of FIG. 9.

DETAILED DESCRIPTION OF THE DRAWINGS

Figure 1:
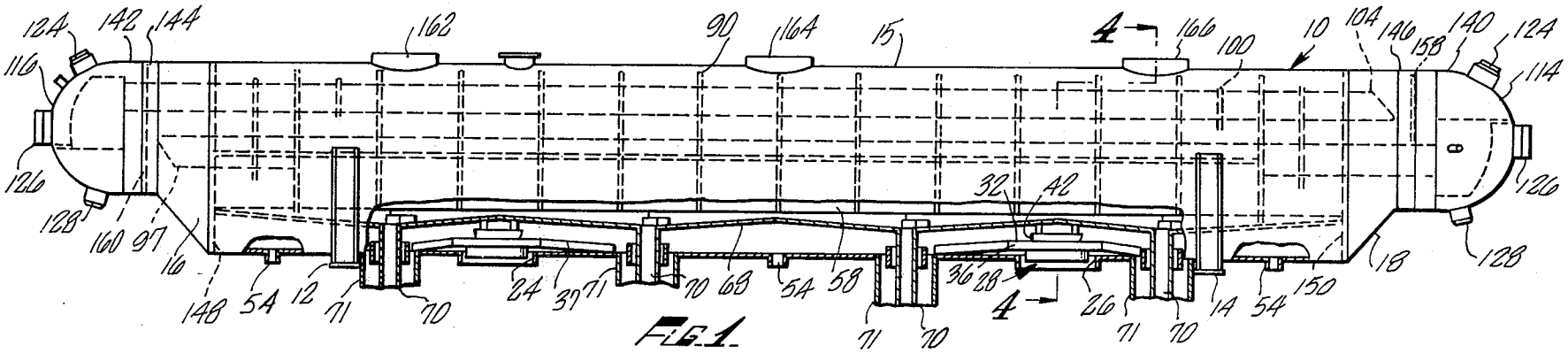
FIG. 1 is an elevation of a moisture separator-reheater of the present invention.
Figure 2:
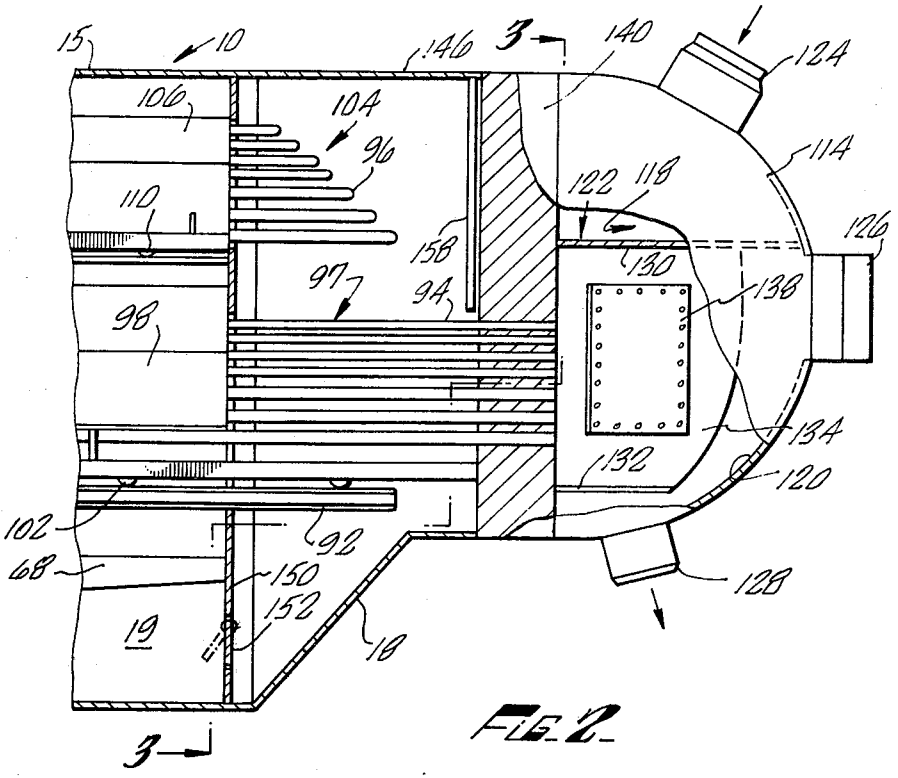
FIG. 2 is a detailed elevation of a moisture separator-reheater of the present invention with a portion of the shell broken away.
Figure 3:
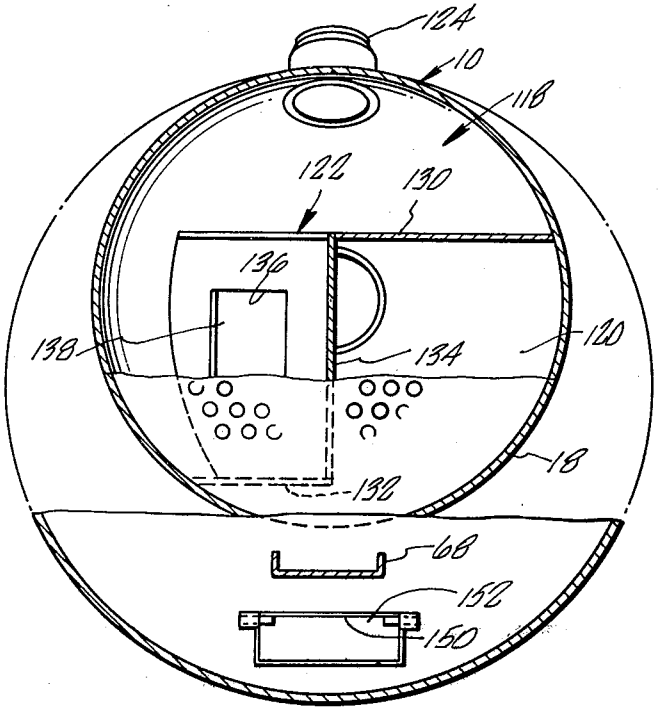
FIG. 3 is a cross-sectional end view taken along line 3—3 of FIG. 2.

Turning in detail to the drawings, a moisture separator-reheater is disclosed as comprising a vessel, generally designated 10, which is substantially cylindrical and horizontally disposed. The vessel 10 is supported on saddles 12 and 14 positioned to cradle the main cylindrical portion of the vessel at two locations. The vessel 10 includes a first cylindrical shell 15 and two adapter segments 16 and 18 which reduce the diameter of the vessel 10 to accommodate the tube bundle headers. The vessel is divided into a main chamber 19 defined by the shell 15 and extending to the adapter segments 16 and 18 and adapter cavities defined by the adapter segments 16 and 18 and extending from the main chamber 19 to the tube sheets and the tube bundle headers.

The main chamber 19 generally includes two banks 56 and 58 of inertial separators which extend the length of the main chamber 19 and are oriented to diverge from a common drainage channel 68 upwardly and outwardly to positions adjacent the shell 15 on either side of tube bundles 97 and 104. The tube bundles 97 and 104 are arranged centrally in the shell 15 in the upper portion thereof and extend beyond each end of the main chamber 19.

Shell 15 includes inlet means for receiving wet steam which has been discharged from a high pressure turbine. The inlet means includes two inlet nozzles 24 and 26 located at the bottom of shell 15. The nozzles are placed at one quarter and three quaters of the length of the main chamber 19 to minimize the distance influent must travel laterally through the shell 15.

Because the inlet nozzles 24 and 26 are located at the bottom of the shell 15, flow from the high pressure turbine must be directed laterally toward the inlet nozzles 24 and 26 and then passed through elbows such that the flow of steam will be directed vertically and evenly into the main chamber 19. At these elbows, a first separation of moisture from the steam occurs due to the change in direction of the flow. The moisture thrown from the flow at the elbow as well as moisture which simply agglomerates and adheres to the walls of the inlet passageways will tend to remain on the walls of the passageways and migrate under the influence of the passing flow to the inlet nozzles 24 and 26. It is beneficial to remove this separated moisture rather than to allow it to migrate to the lip of nozzles 24 and 26 where it may become re-entrained with the steam thereby requiring later separation.

To accomplish a first separation of this water adhering to the walls of the inlet passageways, a skimmer 28 is positioned in each inlet nozzle 24 and 26. Each skimmer 28 includes a skimmer nozzle 30 which has a diameter slightly smaller than that of the inlet nozzles 24 and 26 so that an annular passageway is created between each inlet nozzle 24 and 26 and the corresponding skimmer nozzle 30. The water adhering to the walls of the inlet pasageways will flow into these annular passageways and become separated from the main portion of the inlet flow.

Each skimmer 28 also includes a substantially horizontal plate 32 which extends laterally from the skimmer nozzle 30. Each plate 32 forces the wall water received from along the wall of each inlet nozzle 24 and 26 to remain in the bottom of the main cavity 19 rather than to flow with the incoming steam which is primarily directed through the skimmer nozzles 30. The laterally extending plate 32 is arcuate to better fit within the cylindrical shell 15 as can best be seen in FIG. 4. Flanges 34 and 36 extend downwardly from the laterally extending plate 32 to meet the shell 15. The flanges 34 and 36 act to support the laterally extending plate 32 and the skimmer nozzle 30 and prevent excessive amounts of steam from passing between the inlet nozzles 24 and 26 and the skimmer nozzle 30. This further prevents the re-entrainment of moisture directed through the annular skimmer passageways.

The laterally extending plated 32 extend longitudinally through the shell to baffles 37. The baffles 37 extend from each corner of the laterally extending plates 32 toward drains through the shell.

A baffle means is set within each of the skimmer nozzles 30 to divide and direct the incoming flow from each inlet nozzle 24 and 26 to either side of the main cavity 19. An equal division of the incoming steam allows full utilization of each of the two banks of inertial separators set within the main cavity. By dividing the flow, the baffle means also acts to protect the internal components of the moisture separator-reheater from erosion and corrosion.

Figure 4:
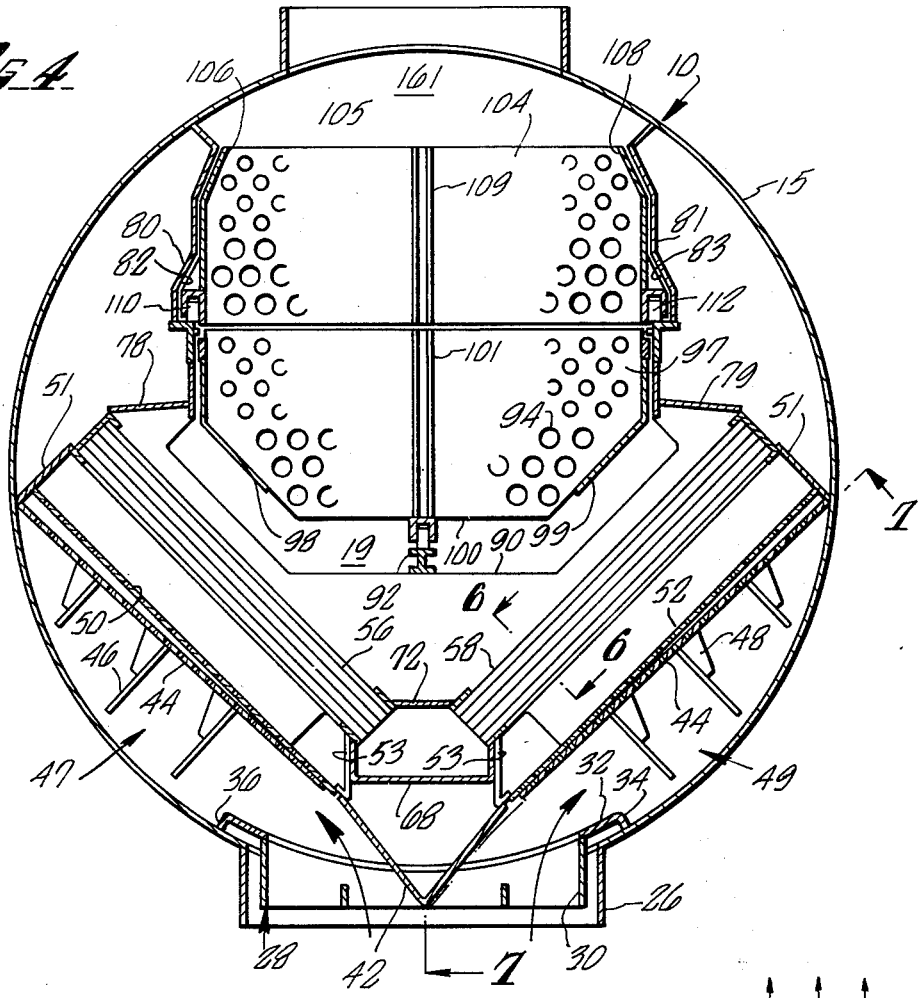
FIG. 4 is a cross-sectional end view taken along line 4—4 of FIG. 1.

The baffle means employed in the present embodiment includes a V-shaped baffle 42 extending from the bottom of each skimmer nozzle 30 upwardly and outwardly as can best be seen in FIG. 4. The V-shaped baffle 42 extends laterally to either side of the skimmer nozzle 30 and is positioned such that each side of the baffle is parallel to the centerline of the shell 15. Each side of the baffle 42 is tapered to become wider at the top of the baffle 42 so that the natural dispersion of steam, once it passes through the inlet nozzles 24 and 26, will not escape the baffling action. Thus, incoming steam is forced to flow in equal, divided portions to either side of the shell 15 for proper use of each blank of separators.

Located above each V-shaped baffle 42 are flow distribution means for redirecting the flow divided by the baffle. The divided flow is redirected longitudinally in either direction along the shell 15 so that the entire length of the shell will receive influent steam. The flow distribution means each include a support 44 which is, in the present embodiment, a plate extending upwardly and outwardly from near the upper edge of the V-shaped baffle 42 to the inner side of the shell 15. There are two supports 44 associated with each inlet nozzle 24 and 26 to receive ech portion of the flow directed thereto by the V-shaped baffle 42. Each of these supports 44 extends in substantially the same direction as the sides of the V-shaped baffle 42 and are inclined from the vertical at roughly 45°. The supports 44 are perforated to give a 50% open area to allow some flow to the separators behind the supports 44.

Extending normal to the surface of each plate 44 as part of the flow distribution means, deflection plates 46 intercept the divided flow moving substantially parallel to the supports 44 and direct it longitudinally in either direction through the main chamber 19. The deflection plates 46 are staggered to separately direct portions of the divided flow from the inlet nozzles 24 and 26 at different levels along the banks of moisture separators. A first pair of deflection plates 46 is placed at the outside edges of each support 44. This first pair of plates receives the outermost portions of the flow through inlet nozzles 24 and 26 and directs this flow longitudinally through the main chamber 19 at the lowermost portion of the banks of moisture separators.

A second pair of deflection plates 46 is positioned above the first pair and closer to the midpoint of the support 44. This higher pair of deflection plates 46 cuts deeper into the flow from the inlet nozzle 24 and 26 than does the first pair of deflection plates 46. The second pair of deflection plates, being above the first pair of deflection plates, directs the flow received longitudinally through the main chamber 19 at a higher point on the moisture separators than did the first pair of deflection plates 46.

A third pair of deflection plates 46 is placed above each second pair and closer together to receive more of the central portion of the divided flow from the inlet nozzles 24 and 26. This upper pair directs flow longitudinally well up on the banks of the moisture separators. The third pair is spaced so that a final portion of the flow from the inlet nozzles 24 and 26 will continue to the extreme upper portion of the moisture separators where it is forced by the converging shell wall to flow longitudinally along the banks of moisture separators.

The deflection plates 46 are substantially rectangular and extend normally from each support plate 44 outwardly to a position almost abutting the shell 15. This extension of the deflection plates 46 can best be seen in FIG. 4. Gussets 48 are positioned behind the deflection plates 46 to provide strength against the dynamic pressure of the incoming flow of steam.

The placement of each support 44 and the deflection plates 46 in combination with the V-shaped baffles 42 advantageously employs the velocity of the incoming steam through inlets 24 and 26 to obtain longitudinal distribution through the main chamber 19. The deflection plates 46 are simple in construction and are placed to redirect the flow of incoming steam without significantly blocking the passageway through which the steam is directed. This forced longitudinal flow of the steam through the main chamber 19 forces the utilization of the entire length of the moisture separator banks as well as the entire length of the reheater tube bundles to enhance the efficiency of the moisture separator-reheater.

The incoming steam, redirected by the flow distribution means on either side of the main chamber 19, then passes through two passageways 47 and 49 on either side of the main chamber 19. These passageways 47 and 49 have cross-sectional areas approaching that of a segment on a cord. The passageways 47 and 49 are defined on one side by the shell 15 and on the second side by perforated plates 50 and 52 which extend the length of the main cavity 19. Thus, the redirected flow moves parallel to the perforated plates 50 and 52 and must turn at right angles to enter the perforations and pass to the moisture separators.

The perforated plates 50 and 52 extend longitudinally the length of the main chamber 19 and diverge upwardly and outwardly substantially parallel to the banks of moisture separators at an angle of 45° from vertical. Closure plates 51 and 53 extend between the perforated plates 50 and 52 and the banks of separators to prevent the flow from reaching the separators without having passed through the flow conditioning perforated plates 50 and 52. The upper closure plates 51 further extend to the shell 15 to prevent flow from the influent passageways 47 and 49 into the upper portions of the vessel 10. The closure plates 51 and 53 also acts as mounts for the perforated plates 50 and 52.

The perforated plates 50 and 52 include a pattern of perforations designed for the quantity of flow anticipated for each moisture separator-reheater. In the preferred embodiment, the perforations are simply round holes extending through and normal to each perforated plate 50 and 52. The perforations constitute 10% of the plate area to achieve the proper direction of flow along the influent passageways 47 and 49 without significantly inhibiting the passage of steam through the perforated plates into the moisture separators. Thus, because the incoming steam tends to continue along the perforated plates 50 and 52 rather than to turn into the perforations, distribution to the entire length of each bank of moisture separators is achieved.

Continuous separation of moisture from the flow of steam occurs as the flow is passed across the V-shaped baffle 42, the supports 44 and the deflection plates 46 and then along the longitudinal passageways 47 and 49 and through the perforated plates 50 and 52. The reduced velocity and changes in direction of the flow tend to allow further moisture agglomeration in the flow and adsorption of moisture on the baffle 42, the flow distribution means, the shell 15 and the perforated plates 50 and 52.

This early extracted moisture is allowed to drain from these components to the bottommost portion of the main chamber 19. The bottom of the main chamber 19 is substantially unrestricted between the several shell drains 54 and 55. Consequently, water separated from the flow of steam before entering the moisture separators is allowed to flow to these shell drains 54 and 55. In the area of the inlet nozzles 24 and 26, the laterally extending plates 32 receive this water and cause it to drain away from the inlet nozzles 24 and 26 to the shell drain 55. Thus, a first separation of water occurs before the steam reaches the moisture separators and this separated water is allowed to freely drain from the shell 15.

There are four shell drains 55 surrounding each of the four separator drains. These shell drains 55 are simply holes cut through the bottom of the shell 15. There are three shell drains 54, one between the inner two shell drains 55 and one on the outboard side of each of the outermost shell drains 55. The outermost shell drains 54 are located midway between the end of the main chamber 19 and the outermost shell drain 55.

The shell drains 54 and 55 are designed to drain water from the main chamber 19 immediately so that a minimum inventory remains at any point in time within the shell. To accomplish this, the drains 54 and 55 are made far larger than the flow anticipated and are placed such that water falling to the bottom of the shell 15 will travel to the least practical distance to the nearest drain. The baffles 37 also enhance drainage to the shell drains 55 from area where the greatest amount of primary separation is anticipated. Sumps are provided to receive the primary drainage through shell drains 54 and 55 and withdraw this water. Pressure is maintained on the shell drains 54 and 55 to inhibit the flow of steam from the moisture separator-reheater, via the water drainage system. Thus, a shell drainage system is provided which reduces the probability and the severity of flashing by enhancing water flow and reducing the inventory of water within the shell.

Once having passed through the perforated plates 50 and 52, the wet steam approaches two banks 56 and 58 of inertial separators. The banks 56 and 58 of inertial separators extend the length of the main chamber 19 and diverge upwardly from a common drain channel to either side of the heat exchange tube bundle. Each bank 56 and 58 of inertial separators is situated substantially parallel to one of the perforated plates 50 and 52 and thus extends upwardly at an angle of about 45°. The banks 56 and 58 of inertial separators do not extend outwardly to the shell 15. Consequently, the closure plates 51 extend between the upper ends of each of the banks 56 and 58 of inertial separators to the perforated plates 50 and 52 and onto the shell wall 15 to provide a barrier to the flow of steam around the inertial separators.

The inertial separators include a series of plates formed to provide a plurality of passageways 64 with abrupt changes in direction. Moisture traps 66 are strategically provided in the passageways 64 to capture and convey liquid which has adhered to the walls of the passageways 64.

The steam is divided up into ribbons of flow which are continually accelerated laterally as they pass through the passageways 64. In this way, water droplets are caused to move to the walls of the passageways. The continuing flow of steam through the passageways then forces the adsorbed moisture to move to the moisture trap 66 and then fall along the traps 66 to the bottom of each of the banks 56 and 58 of the inertial separators. In this way, substantial moisture is separated from the steam flow.

A channel 68 is provided at the bottom of the two banks 56 and 58 of inertial separators. Thus, separated moisture drains from either bank of inertial separators 56 and 58 into the channel 68 for removal. The channel 68 is sloped to the nearest of four drains 70 and thus varies in depth along the length of the shell 15. A cover plate 72 extends between each of the inertial separators above the channel 68 to prevent the moisture collected from becoming re-entrained into the flow of steam once the steam has been dried by the banks 56 and 58 of inertial separators.

Figure 5:
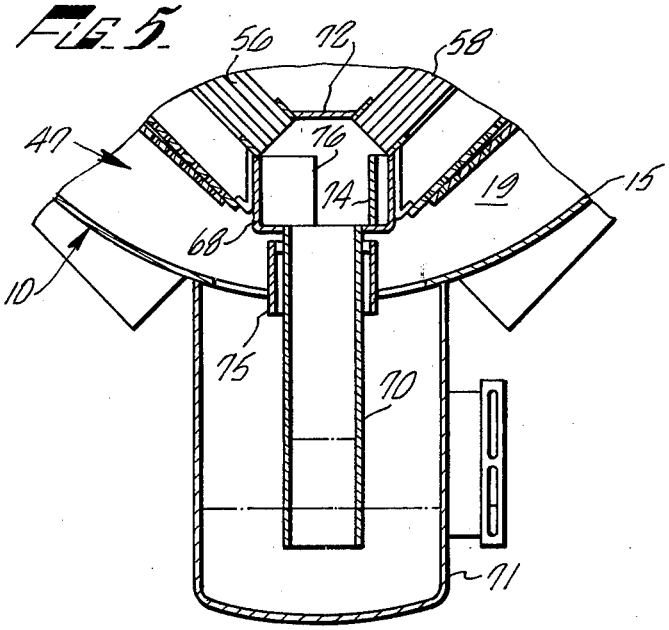
FIG. 5 is a detailed cross-sectional end view illustrating a drain.
Figure 6:
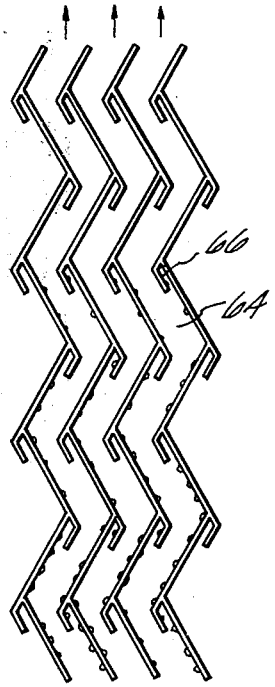
FIG. 6 is a detailed cross-sectional view of an inertial separator taken along line 6—6 of FIG. 4.

The drains 70 extend from the shell 15 well into a sump 71. The flow of steam experiences a pressure drop across the bank of separators 56 and 58 making the pressure in the channels 68 lower than the pressure in either of passageways 47 and 49. Consequently, a differential in the water level is contained within the sumps 71. Within the drains 70, water is drawn up to a higher level than it is in the main portion of the sump 71 as can be seen in FIG. 5. The main portion of each sump 71 is maintained at a pressure equal to that in passageways 47 and 49 because of the shell drains 55.

To insure continuous drainage from the channel 68, baffles 74 and 76 are placed at each drain 70. These baffles are arranged to induce a vortex at each drain 70 in order that a vapor core exists which extends down the drain pipe 70. To prevent a pocket of steam from developing in the main portion of the sump 71 when shell water completely covers shell drains 55, a collar 75 is positioned about the drain 70 such that an annular passage exists around the drain 70. This collar 75 extends upwardly above the bottom of the shell 15 and is less likely to become blinded by shell water. Thus, a continuous steam passage exists even when the shell drains 55 are covered over with water. Supports 77 hold the collar 75 in place. Control of the removal of water from sump 71 is achieved by conventional means such that water level within the sump 71 will not become lower than the bottom edge of the drain 70. This prevents steam from passing in either direction between the passageways 47 and 49 and the channel 68 except through the banks of separators 56 and 58.

Once the flow of steam has passed through the inertial separators and at least partially dried, it is to be reheated for passage through a low pressure turbine. The reheating step further upgrades the steam by raising the temperature. In this way, steam may be superheated to provide flow to low pressure turbines which will not create excessive erosion of the turbines resulting from moisture droplets entrained within the steam and which will provide increased efficiency to the power generating station.

To direct flow through the reheater portion, a passageway is created for inward and upward flow along the main chamber 19 from the inertial separator banks 56 and 58. Plates 78 and 79 extend inwardly from the upper edges of the inertial separator banks 56 and 58 to two vertical wall assemblies 80 and 81. The vertical wall assemblies 80 and 81 extend upwardly to near the top of the shell 15 to form a longitudinal tube bundle passageway through which dried steam may pass vertically from the main chamber 19. The vertical wall assemblies 80 and 81 act as thermal liners and tube bundle supports as well as flow directing panels. The vertical wall assemblies 80 and 81 include channels 82 and 83 having a horizontal guideway for supporting the upper tube bundle.

The vertical wall assemblies 80 and 81 are associated with support for the devices contained within the main chamber 19. This support is provided by a plurality of bundle support plates 90 extending transversely in the main chamber 19 to the shell 15 at a number of equally spaced locations along the length of the main chamber 19. The bundle support plates 90 extend from the vertical wall assemblies 80 and 81 to the shell 15 at the upper portion of the reheater outwardly of the vertical wall assemblies 80 and 81 and also extend down between the inertial separators to divide each inertial separator bank 56 and 58 into several discontinuous lengths. The bundle support plates 90 further extend in the lower portion of the main chamber 19 on either side of the inertial separator banks 56 and 58 outwardly to the perforated plates 50 and 52 and inwardly to meet symmetrically above the channel cover plate 72. These bundle support plates 90 thus further support the inertial separators in banks 56 and 58 and support the tube bundles positioned in the heat exchange area of the moisture separator-reheater. A rail 92 extends along the upper edge of the center portion of the bundle support plates 90 to continuously support the tube bundle and provide for its facile insertion or retraction from the shell 15.

A two-stage heat exchange system is illustrated in the preferred embodiment. A single stage unit may also be employed where appropriate. In either event, the tube bundles consist of a plurality of tubes 94 running substantially the length of the vessel 10 and having horizontal U-bends 96. The number of tubes is determined by conventional heat exchange principles and the tubes shown in the figures of the present disclosure are constructed for clarity of the invention and are not intended to accurately represent the number of tubes actually employed in any one capacity unit. The tube bundles fit closely between the vertical wall assemblies 80 and 81 in order that flow must pass upwardly through the tubes rather than around to the outlets. Further, each tube bundle includes sidewalls which also contain the flow. The lower tube bundle, generally designated 97, includes converging side panels 98 and 99 which extend the length of the lower tube bundle 97 to force the flow of steam to enter the lower tube bundle 97 at a central position along the lower side of the tube bundle. As the inertial separator banks 56 and 58 extend upwardly on either side of the lower tube bundle 97, flow from the inertial separators must flow around the converging side panels 98 and 99 and then upwardly into the tube bundles.

The tubes 94 of the lower tube bundle 97 are supported by a structure including the sidewalls 98 and 99 which extend down the sides of the lower tube bundle and converge to partially restrict the inlet area into the tube bundle 97. Tube support plates 100 extend perpendicular to the tubes 94 to join with the sidewalls 98 and 99 and inner vertical plates 101. Rollers 102 are positioned beneath the tube support plates 100 and the inner vertical plates 101 to support the lower tube bundle 97 and roll along the rail 92 such that the lower tube bundle 97 may be periodically removed for replacement or repair.

The upper tube bundle, generally designated 104 is positioned directly above the lower tube bundle 97. The upper tube bundle 104 also incorporates tube support plates 105 extending between upper sidewalls 106 and 108 and inner vertical plates 109. The upper sidewalls 106 and 108 extend down to a position adjacent to the upper edge of the lower sidewalls 98 and 99 to define a continuous passageway through which the steam may pass. Rollers 110 and 112 are positioned along the upper walls 106 and 108 to support the upper tube bundle 104 on the vertical wall assemblies 80 and 81. The tube bundles are supported such that they are sloped toward their respective outlets to promote drainage of condensate.

The two tube bundles 97 and 104 are controlled from opposite ends of the shell. The lower tube bundle 97 is associated with header 114 and tube sheet 140 and the upper tube bundle 104 is associated with header 116 and tube sheet 142. The headers are substantially hemispherical in shape and each includes an inlet chamber 118 and an outlet chamber 120. The inlet chamber 118 and the outlet chamber 120 are defined by a partition 122 which separates the inlet openings from the outlet openings on the several tubes and also circumvents the tube-side steam inlet 124, the manway 126 and the tube-side outlet 128. The partitions 122 in each header 114 and 116 are similar but inverted with respect to each other.

To accomplish the partitioning of the inlet chamber 118 from the outlet chamber 120 for the lower tube bundle 97 and at the same time circumvent the various ports into the header 114, a first horizontal plate 130 extends halfway across the header 114 at the tube sheet above the tube outlets. A second horizontal plate 132 extends to the midpoint of the header 114 at the tube sheet below the tube inlets. A vertical plate 134 extends between the first and second horizontal plates 130 and 132. This vertical plate 134 is not aligned with the centerline of the shell 10 but rather extends from a central position at the tube sheet at an angle to the header wall 114 thus avoiding the manway 126. A hatch 136 is provided through the vertical plate 134 and includes a hatch cover 138 which may be removed for access from the manway 126 to the inlet chamber 118. Thus, incoming tube-side steam may be directed to the tube-side steam inlet 124, passed through the tubes 94 and allowed to drain from the tube-side outlet 128. This is equally true for the upper tube bundle 104 and header 116.

The headers 114 and 116 extend to respective tube sheets 140 and 142. The adapter segments 16 and 18 extend from the main shell 15 to the other side of the tube sheets 140 and 142. Cylindrical portions 144 and 146 of the adapter segments 16 and 18 are provided adjacent to each tube sheet 140 and 142 where the adapter segments 16 and 18 may be cut forming a part line for removal of the tube bundles 97 and 104.

The tubes 94 in each tube bundle 97 and 104 extend substantially the entire length of the moisture separator-reheater and return. The U-bends 96 close each longitudinal portion of the tubes 94. The tubes 94 and U-bends 96 are horizontally disposed such that they will experience similarly conditioned shell-side flow along their entire length. This horizontal disposition of the tubes 94 and U-bends 96 rather than the conventional vertical disposition allows more efficient operation of the moisture separator-reheater and prevents damaging thermal stress. By having the horizontal orientation of tubes during steady state operation, the temperature of each side of the U-shaped tube assembly is more equal. Thus, tube distortion is not experienced due to a difference in thermal strain between tubes. Under transitory conditions, this problem may be compounded by the unequal heating and cooling which would occur if the tubes were not situated in similar locations though opposite sides of the shell 15.

With horizontally disposed tubes, the lowermost tubes of each tubes of each tube bundle 97 and 104 are positioned to transfer the greatest amount of heat because the shell-side steam is at its lowest temperature. Conversely, the uppermost tubes of each tube bundle 97 and 104 experience the least heat transfer because the shell side steam is dry and at an elevated temperature.

This differential in heat transfer between the lowermost tubes and the uppermost tubes of each tube bundle creates different rates of cooling in the tube-side steam. An equal pressure differential exists for all tubes in a given tube bundle between the header inlet and outlet chambers. Therefore, with the large differential in heat transfer between tubes of the same tube bundle, severe maldistribution of the tube-side flow can occur. The lowermost tube would experience excessive condensing and subcooling of the steam flowing therethrough. This could result in the lower tubes becoming filled with subcooled water toward their outlets while steam is issuing from the outlets of the uppermost tubes of the tube bundle. As a result, the lowermost tubes would experience cyclical flow as the lower tubes alternately are filled with subcooled water and then blown out by hotter steam and the efficiency of the system would be greatly reduced. This cyclical flow will also produce cyclical thermal stresses resulting in early failure of the tubes.

To overcome this difference in heat transfer between the lowermost tubes and the uppermost tubes in each tube bundle, tubes of different diameters have been employed. In the lowermost portion of each tube bundle, larger diameter tubes have been used while smaller diameter tubes are used in the upper portion of the tube bundle. In the preferred embodiment, both the lower tube bundle 97 and the upper tube bundle 104 have two different sized tubes arranged to overcome this variation in heat transfer. The bottom half of each tube bundle includes tubes having a one-inch outside diameter while the upper half of each tube bundle has tubes of three-quarter inch outside diameters. In this way, a desirable discharge from the upper and lower tubes of each tube bundle may be experienced.

To further insure a proper range of heat transfer across each tube bundle, certain of the tubes are constructed with different outer surfaces to effect different heat transfer rates per unit area through the tube walls. In the preferred embodiment, the surface change is accomplished by using both plain and integrally finned tubes. At the bottom of each bundle, the lowest tubes do not have fins on the return leg. At one-third of the way up the tubes in each bundle, each leg of the tubes is finned. Between the bottom and the one-third position, the amount of finned tubes employed increases progressively from zero to fully finned on the return legs.

When using a two-stage heat exchange system, the upper tube bundle is configured in such a way that the return legs of the tubes are on the opposite side of the centerline of the shell 15 from the return legs of the tubes of the lower tube bundle. In this way, the flow on either side of the shell through the tube bundles passes the same amount of unfinned tubing.

To reduce thermal stress during non-steady state conditions, two end plates 148 and 150 isolate the tube sheets 140 and 142 and the U-bends 96 from the main flow of steam. The portions of the shell cavity located between the end plates 148 and 150 and the tube sheet 140 and 142 heat up more slowly and cool off more slowly than does the main portion of the shell cavity because of the end plates. However, the end plates 148 and 150 are not sealed. Rather, the tube bundles extend through openings in the end plates 148 and 150 and a flapper plate 152, crudely hinged at 154 and 156 allows some steam flow and permits rapid pressure equalization between the main chamber and the portions behind each of the end plates 148 and 150. This prevents buckling of the end plates 148 and 150. Further tube sheet covers 158 and 160 is provided at each end of the shell to further insulate the tube sheets 140 and 142 from excessive and transitory thermal stress.

The flapper plates 152 are of steel plate causing their own weight to retain them in the closed position. However, sufficient overpressure will force the flapper plates 152 to move in either direction before buckling of the end plates 148 and 150 can occur.

The upper tube bundle 104 does not extend to the very top of the shell 15. Consequently, a passageway 161 extending the length of the main chamber 19 is formed between the top of the upper tube bundle and the shell 15 and between the two vertical wall assemblies 80 and 81. Outlet means are provided to vent this upper passageway allowing the reheated steam to pass to the low pressure turbine from out of the tube bundles. Three outlets 162, 164 and 166 are shown in the present embodiment.

Thus, a moisture separator-reheater has been disclosed which employs a horizontal configuration with efficient distribution of incoming steam to both the moisture separators and the heat exchange portions of the reheater. While embodiments and applications of this invention have been shown and described, it would be apparent to those skilled in the art that many more modifications are possible without departing from the inventive concepts herein described. The invention, therefore, is not to be restricted except by the spirit of the appended claims.

What is claimed is:

1. A moisture separator-reheater comprising
a cylindrical, horizontally disposed shell;
inlet means at the bottom of said shell for receiving moisture laden steam into said shell;
outlet means at the top of said shell for discharging dried, heated steam from said shell;
at least one tube bundle extending longitudinally through an upper portion of said shell;
drainage means extending longitudinally and centrally through a lower portion of said shell;
a plurality of moisture separators extending in two banks longitudinally through said shell, said banks diverging from said drainage means upwardly to each side of said tube bundle;
baffle means for dividing flow through said inlet means toward each bank of said separators; and
flow distribution means for directing the divided flow longitudinally through said shell, each flow distribution means including a plurality of plates perpendicular to the divided flow, said plates being staggered to separately direct portions of the divided flow at different levels along the banks of said separators.

2. The moisture separator-reheater of claim 1 wherein each succeeding plate along the divided flow is positioned progressively closer to the center of the divided flow.

3. The moisture separator-reheater of claim 1 wherein said flow distribution means further includes a support disposed substantially parallel to the divided flow and parallel to the longitudinal axis of said shell.

4. The moisture separator-reheater of claim 3 wherein said plates extend from said support to a position adjacent said shell to influence substantially all of the divided flow.

5. The moisture separator-reheater of claim 3 wherein the support includes a perforated plate.

6. The moisture separator-reheater of claim 5 wherein the open area of said perforated plate is 50% of the total area of said perforated plate.

7. The moisture separator-reheater of claim 1 wherein said inlet means include two inlet nozzles disposed at one-fourth and three-fourths the length of said shell.

8. The moisture separator-reheater of claim 1 further comprising perforated plates positioned in front of and substantially parallel to each of the banks of said inertial separators.

9. The moisture separator-reheater of claim 1 wherein the banks of said inertial separators are disposed at 45° angles from the vertical.

10. The moisture separator-reheater of claim 1 wherein said drainage means includes a common drainage channel extending between the lower ends of the banks of said inertial separators and including drains located along said channel for exhausting water from said shell.

11. The moisture separator-reheater of claim 1 wherein said baffle means includes a V-shaped plate set within each inlet means.

12. The moisture separator-reheater of claim 1 wherein said tube bundle includes tubes having larger outside diameters at the bottom of said bundle and tubes having small outside diameters at the top of said bundle.

13. The moisture separator-reheater of claim 1 wherein said tube bundle includes tubes of different heat transfer surface characteristics to equalize the tube said outlet temperatures.

14. In a moisture separator-reheater having a horizontally disposed shell and at least a first tube bundle extending longitudinally from a tube sheet into the shell, the improvement comprising
a vertical plate extending to partition the shell near the tube sheet;
a pressure relief opening through said vertical plate; and
a flapper plate hinged to said vertical plate to fill said pressure relief opening.

15. In a moisture separator-reheater having a horizontally disposed shell, banks of moisture separators extending longitudinally through said shell and at least one heat transfer tube bundle extending longitudinally through said shell, the improvement comprising
a plurality of shell drains spaced along the lowermost portion of said shell to minimize the distance water must flow to any one of said shell drains, said shell drains being of sufficient area to drain all water from said shell during steady state flow without the buildup of a static head, at least a portion of said shell drain including a first passageway for draining water from said shell and a second passageway extending into said shell through said drain passageway a distance above the core of said shell to maintain a vapor passageway through said drain opening.

16. A moisture separator-reheater comprising
a horizontally disposed shell;
a moisture separator;
at least one longitudinally extending tube bundle including a plurality of tubes, each said tube having a feed leg, a horizontally disposed U-bend and a return leg;
an inlet common to each said tube of said tube bundle;
an outlet common to each said tube of said tube bundle;
shell side inlet means; and
shell side outlet means, said shell side inlet means and said shell side outlet means allowing steam flow upwardly through said shell,
the lowermost of said tubes being of larger diameter and the uppermost of said tubes being of smaller diameter and the uppermost of said return legs having integrally formed, outwardly disposed fins, the lowermost of said return legs being smooth walled.

17. The moisture separator-reheater of claim 16 wherein said tubes include progressively more finned surface on said return legs from the lower most tubes to the tubes located at one-third the height of the tube bundle, said tubes from one-third the height the tube bundle to the top of the tube bundle being completely finned.

18. The moisture separator-reheater of claim 17 further including two tube bundles, said first tube bundle including said smooth return legs on one side of said shell and said second tube bundle including said smooth return legs on the other side of said shell.

19. A moisture separator-reheater comprising a cylindrical, horizontally disposed shell;

inlet means at the bottom of said shell for receiving moisture laden steam into said shell;

outlet means at the top of said shell for discharging dried, heated steam from said shell;

at least one tube bundle extending longitudinally through an upper portion of said shell and including a plurality of tubes, each said tube having a feed leg, a horizontally disposed U-bend and a return leg;

drainage means extending longitudinally and centrally through a lower portion of said shell;

a plurality of moisture separators extending in two banks longitudinally through said shell, said banks diverging from said drainage means upwardly to each side of said tube bundle;

baffle means for dividing flow through said inlet means toward each bank of said separators;

flow distribution means for directing the divided flow longitudinally through said shell, each flow distribution means including a plurality of plates perpendicular to the divided flow, said plates being staggered to separately direct portions of the divided flow at different levels along the banks of said separators, the lowermost of said tubes being of larger diameter and the uppermost of said tubes being of smaller diameter and the uppermost of said return legs having integrally formed, outwardly disposed fins, the lowermost of said return legs being smooth walled.

* * * * *